US008548181B2

(12) United States Patent
Kraemer

(10) Patent No.: US 8,548,181 B2
(45) Date of Patent: Oct. 1, 2013

(54) INFLATABLE EAR MOLD CONNECTION SYSTEM

(75) Inventor: Wolfgang Kraemer, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 0 days.

(21) Appl. No.: 13/702,665

(22) PCT Filed: Jul. 13, 2011

(86) PCT No.: PCT/EP2011/061962

§ 371 (c)(1),
(2), (4) Date: Dec. 7, 2012

(87) PCT Pub. No.: WO2012/007508

PCT Pub. Date: Jan. 19, 2012

(65) Prior Publication Data

US 2013/0101147 A1 Apr. 25, 2013

Related U.S. Application Data

(60) Provisional application No. 61/363,814, filed on Jul. 13, 2010, provisional application No. 61/385,635, filed on Sep. 23, 2010.

(51) Int. Cl.
*H04R 25/00* (2006.01)

(52) U.S. Cl.
USPC ..... 381/322; 381/312; 381/150

(58) Field of Classification Search
USPC ..... 381/23.1, 312, 322, 328, 150, 151, 381/370, 380
See application file for complete search history.

(56) References Cited

U.S. PATENT DOCUMENTS

| | | | |
|---|---|---|---|
| 7,227,968 | B2 | 6/2007 | Van Halteren et al. |
| 7,425,196 | B2 | 9/2008 | Jorgensen et al. |
| 2002/0196958 | A1 | 12/2002 | Halteren et al. |
| 2010/0002897 | A1 | 1/2010 | Keady |
| 2010/0322454 | A1 | 12/2010 | Ambrose et al. |
| 2011/0079227 | A1 | 4/2011 | Turcot et al. |

FOREIGN PATENT DOCUMENTS

| | | | |
|---|---|---|---|
| EP | 1272003 | A1 | 1/2003 |
| WO | 2010132359 | A2 | 11/2010 |

*Primary Examiner* — Brian Ensey
*Assistant Examiner* — Norman Yu
(74) *Attorney, Agent, or Firm* — Laurence A. Greenberg; Werner H. Stemer; Ralph E. Locher

(57) ABSTRACT

An inflatable ear piece is formed for insertion and placement in an external auditory canal. The ear piece has an inflatable balloon that may be selectively inflated and deflated. When the balloon is inflated, it expands and braces against the walls of the auditory canal. The ear piece has a receiver module with a sound generator and a connection to an exterior device. The sound waves generated in the receiver module are guided to the ear drum via a carrier which also holds the balloon. A pump and valve is provided for inflating, or selectively deflating, the balloon. The pump is connected by way of a micro tube that projects centrally inside the sound channel of the balloon carrier and its tip projects into a radial projection or a bridge across the sound channel. The receiver and balloon modules may be connected in any rotational orientation.

15 Claims, 4 Drawing Sheets

INFLATABLE EAR MOLD CONNECTION SYSTEM

BACKGROUND OF THE INVENTION

Field of the Invention

The invention relates to an ear piece for a hearing device, in particular, an inflatable ear mold or an ear piece with an inflatable balloon. The ear piece is particularly suitable for delivering sound from a hearing aid or an audio player.

Along with the ever-increasing miniaturization of electronic devices and the increasing prevalence of audiological devices that require direct delivery of sound to the human ear, there is a desire to provide ever smaller devices that may be placed in the auditory canal of a user.

For example, hearing aids are wearable hearing apparatuses which are used to supply the hard-of-hearing. A variety of different configurations of hearing devices are known, such as, for example, behind-the-ear hearing devices (BTE), hearing device with an external receiver (RIC: receiver in the canal) and in-the-ear hearing devices (ITE), e.g. also concha hearing devices or canal hearing devices (ITE—in-the-ear, CIC—completely in the canal). Similarly, headphones for the personal delivery of auditory materials have recently become more miniaturized and they have progressed to very small earbuds with in-the-canal speakers.

Primarily important components of a hearing device include an input converter (e.g., a microphone), an amplifier, and an output converter. In the case of a sound player (e.g., an MP3 player), the signal originating from a memory is amplified and fed to the output converter. Typically, the output converter in an electroacoustic converter (e.g., a miniature loudspeaker, bone conduction transducer) which converts the electrical signal into a mechanical vibration. In the case of a loudspeaker, the vibration is converted to longitudinal pressure waves, also referred to as sound waves, which impinge on the tympanic membrane of the user. There, the sound waves are converted into neurological signals which are fed to the brain, where they are decoded for content.

U.S. Pat. No. 7,227,968 B2 describes a two-part hearing aid in which the receiver, which is separate from the remaining components, may be inserted deep into the auditory canal. The receiver houses a speaker, which is driven by way of an electrical connection through the canal. The receiver housing is surrounded by an inflatable soft shell, which, when inflated and thus expanded, fixes the receiver in position in the auditory canal. Similarly, U.S. Pat. No. 7,425,196 B2 also describes a receiver module for a hearing aid that may be positioned deep in the auditory canal. The receiver housing is surrounded by an expandable material, which may be expanded against the walls of the canal.

It is desirable for the insertion members of the ear piece to be replaced at certain intervals. Typically, only those parts which come into contact with the ear canal are replaced and the electronics (i.e., the receiver or receiver module) are returned into the canal. It is quite difficult and cumbersome to refurbish currently available state of the art devices and it is therefore desirable to render the refurbishment, and even the original assembly, less complicated and more efficient.

BRIEF SUMMARY OF THE INVENTION

It is an object of the invention to provide an inflatable ear piece, which overcomes several disadvantages of the heretofore-known devices and methods of this general type and which provides for a device that may be inflated for safe placement in the ear canal and that may be deflated and removed from the ear canal with little effort. The ear piece, furthermore, should be simple in its assembly and it should be modular for easy and simple refurbishment.

With the foregoing and other objects in view there is provided, in accordance with the invention, an ear piece for a hearing device which comprises:

- an inflatable ear mold (IEM) for insertion and placement in an ear canal, said inflatable ear mold (IEM) having a carrier and an inflatable balloon sealingly mounted on said carrier;
- a receiver module having a mount on a forward end thereof for connecting said receiver module to said carrier and said balloon;
- said carrier having an axial bore formed along a central axis thereof, said bore forming a sound channel for conducting sound from said receiver module towards an ear drum inwardly bounding the ear canal;
- a radial projection formed on a wall of said axial bore and jutting at least into a center of said axial bore and intersecting said central axis, said radial projection having an opening aligned with the central axis of said axial bore, said radial projection having a bore formed therein fluidically connecting an interior inflation space of said balloon with said opening;
- a micro tube projecting centrally into said axial bore when said receiver and said carrier are connected, and projecting into and sealing against said opening in said radial projection, for enabling said balloon to be inflated, and optionally deflated, through said micro tube.

The inflatable ear mold (IEM) must be filled with a fluid (air or other gas, liquid) to assure the tight fit in the ear canal. Since the IEM must be replaceable, there is a need for a clever connection between the fluid source (e.g. a pump) and the IEM. Also, the handling and normal operation of such ear molds is a problem, because connecting two parts in a fluid-tight manner normally requires a special alignment of the two parts. This is even more critical at the very small dimensions which are of primary interest here. By way of example, the receiver module of the canal-insertible ear mold has width and height dimensions in the neighborhood of approximately 2-3 mm (approx. 0.08-0.1 inches)

The instant invention solves these and other problems in an elegant manner by way of a providing an air-injection needle that projects centrally from the receiver module into the balloon carrier.

There is no need to rotationally align the snap on part with the receiver.

In accordance with an added feature of the invention, radial projection is an integral part of a bridge reaching across said axial bore and connecting to an inside wall of said carrier at diagonally opposed locations.

In accordance with an additional feature of the invention, the receiver module contains a sound source and wherein sound generated thereby is conducted through a forward wall of said receiver module, through said mount on said forward end thereof, and through said axial bore formed in said carrier.

In accordance with another feature of the invention, the receiver module contains a fluid source connected to said micro tube for selectively inflating said balloon. Preferably, a fluidic connection is automatically formed and sealed between said fluid source and an interior of said inflatable balloon when said receiver module is connected to said carrier.

In accordance with a further feature of the invention, said fluid source is a pump assembly comprising an air pump for inflating said balloon and a deflation valve for deflating said balloon.

In accordance with again an added feature of the invention, said receiver module is mounted to project the sound waves through said mount and is connected by way of a signal line to a device for delivering electronic signals for processing in said receiver module. In an embodiment of the invention, the signal line includes an electrical cable carrying electrical control signals and an energy supply.

In accordance with again an additional feature of the invention, there is provided a tube pneumatically connecting said micro tube through said receiver module with an exterior pump for selectively inflating said balloon.

In a preferred embodiment of the invention, the mount is a snap-on bulb and said carrier is formed with substantially congruent opening, wherein said carrier may be snapped onto said mount, and said micro tube is formed with a hollow needle tip penetrating into said radial projection as said carrier is snapped onto said mount, for contemporaneously forming a pneumatic connection to the interior of said balloon.

As noted, the inflatable ear piece may be combined with any of a plurality of audiological devices, such as a hearing aid, an MP3 player, a cell phone, or any other such electronic device.

In the case of a hearing aid implementation of the invention, the microphone, the amplifier, the control unit, and the power supply is disposed in an external unit, such as a BTE (behind-the-ear) unit or an ITE (in-the-ear) unit, or in a CIC or concha device. The inflation pump may be disposed in/on the ear piece itself or in the external or partly inserted unit. The inflatable (deep-insertion) ear piece is electrically connected to the other unit by way of an electrical control cable and, in one case, also through a pneumatic hose.

The placement and fixation of the respective devices by way of otoplastic materials need not be described in further detail. Those of skill in the art of hearing devices are quite familiar with the pertinent technology and are able to configure the respective system according to the specific requirements.

Other features which are considered as characteristic for the invention are set forth in the appended claims.

Although the invention is illustrated and described herein as embodied in an inflatable ear piece to be inserted into an auditory canal, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DETAILED DESCRIPTION OF THE INVENTION

Figure 1:
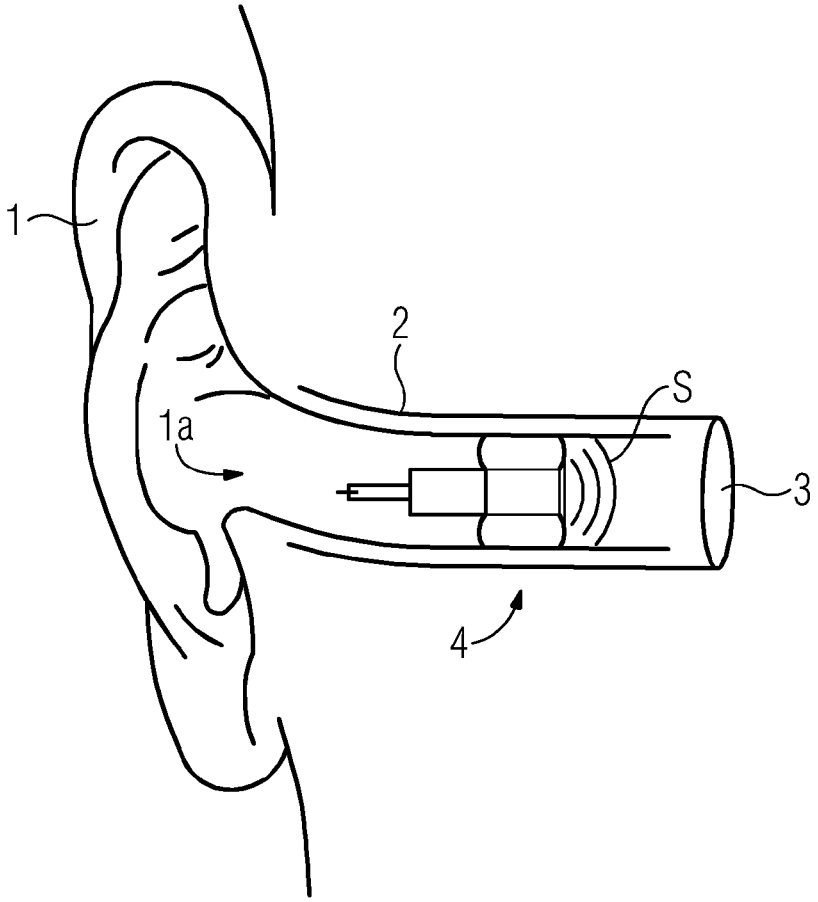
FIG. 1 is a schematic view of an outer ear with an auditory canal leading to an ear drum and an inflatable ear mold inserted into the canal.

Referring now to the figures of the drawing in detail and first, particularly, to FIG. 1 thereof, there is seen a human ear 1 and an external auditory canal 2. The auditory canal is inwardly bounded by a tympanic membrane 3, also referred to as the eardrum. In unassisted hearing, pressure waves (sound waves are longitudinal waves with changes in pressure) are funneled at the concha 1*a* of the ear 1, they travel through the external auditory canal 2, also referred to as the ear canal or, simply canal, before they impinge on the tympanic membrane 3.

In assisted hearing, such as with hearing aids, the propagation of the sound waves through the auditory canal 2 is interrupted. The sound waves are instead picked up by a microphone or the like, the resulting signal is processed, typically by way of digital signal processing, and the processed signal is utilized to excite a loudspeaker, typically in the vicinity of or at the tympanic membrane 3. In the case of ear buds for music or telephony, the sound waves are directly injected at the concha 1*a* for delivery through the auditory canal 2. The novel ear piece 4 may include a sound generator (i.e., a speaker, oscillator) or it may be configured for simple conduction of sound waves to the membrane 3.

For proper reference, a receiver module 5 has a height of approximately 2 mm and a width of approximately 2.7 mm. The acoustic sound channel has an equivalent area of a circular cross-section of 1.2 mm and an air inflation channel has an equivalent circular cross-section of approximately 0.6 mm. In order to prevent unwanted deflation, a static airtight seal of the inflated balloon should last for a minimum of 16 hours, which corresponds to a single-day use. The connection to the sound channel does not require a completely airtight seal, but a certain amount of seal should be provided so as to prevent acoustic feedback.

Figure 2:
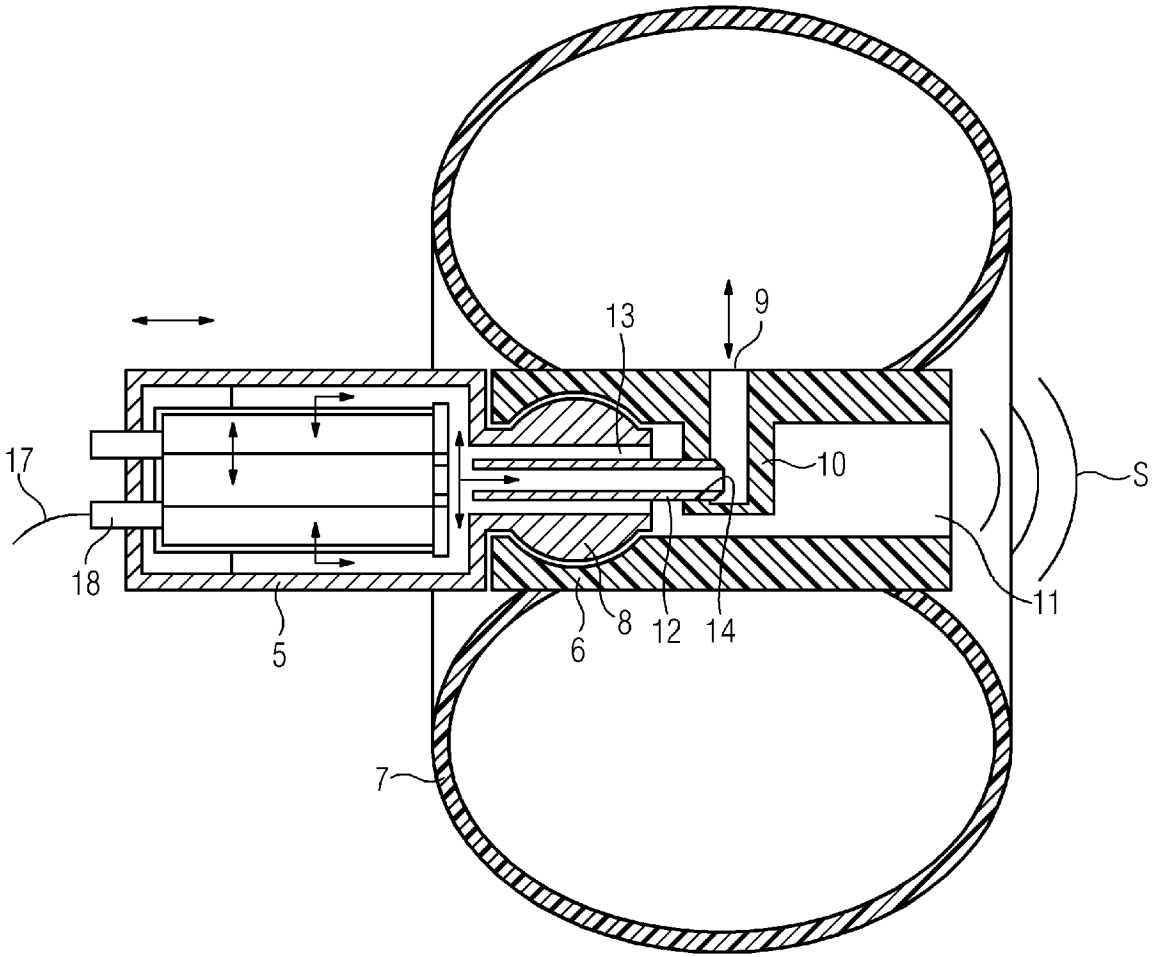
FIG. 2 is a longitudinal section taken through an ear piece according to the invention, formed of a receiver module and an inflatable balloon module.

Referring now to FIG. 2, there is seen an ear piece 4 according to the invention with the receiver module 5, a carrier 6, and an inflatable member 7. The carrier 6 and the inflatable member 7 together form an inflatable ear mold (IEM), or a balloon module. The carrier 6 is formed of a relatively hard material and the inflatable member 7 is joined and fluid-tightly sealed to the carrier 6. The latter is formed with a bulb opening which is congruent with a mount in the form of a snap-on dome 8 or a bulb 8 formed on the forward end of the receiver module 5. The inflatable member 7 may be in the form of a balloon or a bag or an accordion-type bellows, and may be simply referred to herein as a balloon 7. The term "balloon," however, should be understood in its broadest sense as an inflatable member. It may be in the form of a balloon with resiliently stretchable material, or a bag, or an accordion-type bellows with folded/crimped balloon shapes. Further the material is chosen such that it provides a pleasant haptic feel as it is pressed against the wall of the ear canal 2 and, once inflated, does not shift relative to the canal 2. The balloon 7 is formed of a flexible material which is impermeable to cerumen, or earwax, and also to water. The balloon 7 is preferably formed of silicone or latex, or any of the known flexible materials that are used for otoplastics and other cavity-insertible products known, especially, in the hearing aid arts. It may further be covered on the laterally outside walls, i.e., the walls that are braced into contact with the walls of the ear canal 2, with a soft silicone or rubber material layer.

As illustrated here, the balloon 7 resembles a tubeless tire, that is, it is sealed against the rim of the carrier 6 and, upon inflation, it forms a doughnut shaped thoroid fluid space. The fluid space, which is typically inflated with air, opens into a bore opening 9 formed in the carrier 6. The bore opening 9 is continued in a radial projection 10, in the form of an appendix, that points radially inward into an axial opening 11 of the carrier 6. The axial opening 11 carries the sound waves from the receiver 5 to the ear drum 3. The appendix 10 forms only a minor obstruction inside the sound channel and does not have an appreciable effect on the sound conduction. The radial projection 10 may also continue across the entire opening and thus form a bridge which may or may not issue into a second opening 9 across the illustrated opening.

The receiver module 5 carries a micro tube or needle 12 for the delivery of air to and from the air space inside the balloon 7. The needle 12 is mounted in the center of the bulb 8 and also centrally inside a sound tube 13 that projects axially through the bulb 8. The needle 12 is aligned so as to protrude into an opening 14 formed in a radial projection 10, referred to as an appendix 10, when the receiver module 5 and the balloon module 6, 7 are connected to one another. That is, the opening 14 is located exactly centrally inside the assembly. The radial projection 10 may also be formed as a (narrow) bridge extending entirely across the sound channel 11 and it may even be connected to a further inflation opening 9 formed diagonally across the illustrated opening 9.

As can be seen, the entire assembly is rotationally symmetrical—with the exception, of course, of the appendix 10—so that the balloon module 6, 7 may be aligned in any rotational orientation relative to the receiver module 5. This is highly advantageous when the two modules are connected to one another, be it in the original manufacture or when the balloon module is replaced by the audiologist or even be the user for refurbishment or retrofit. No rotational alignment of the parts is required. The needle will always "find" the opening 14 and the needle 12 is assured to always penetrate and project into the opening 14 leading into the appendix 10 and opening into the inflation space inside the balloon 7.

Figure 3:
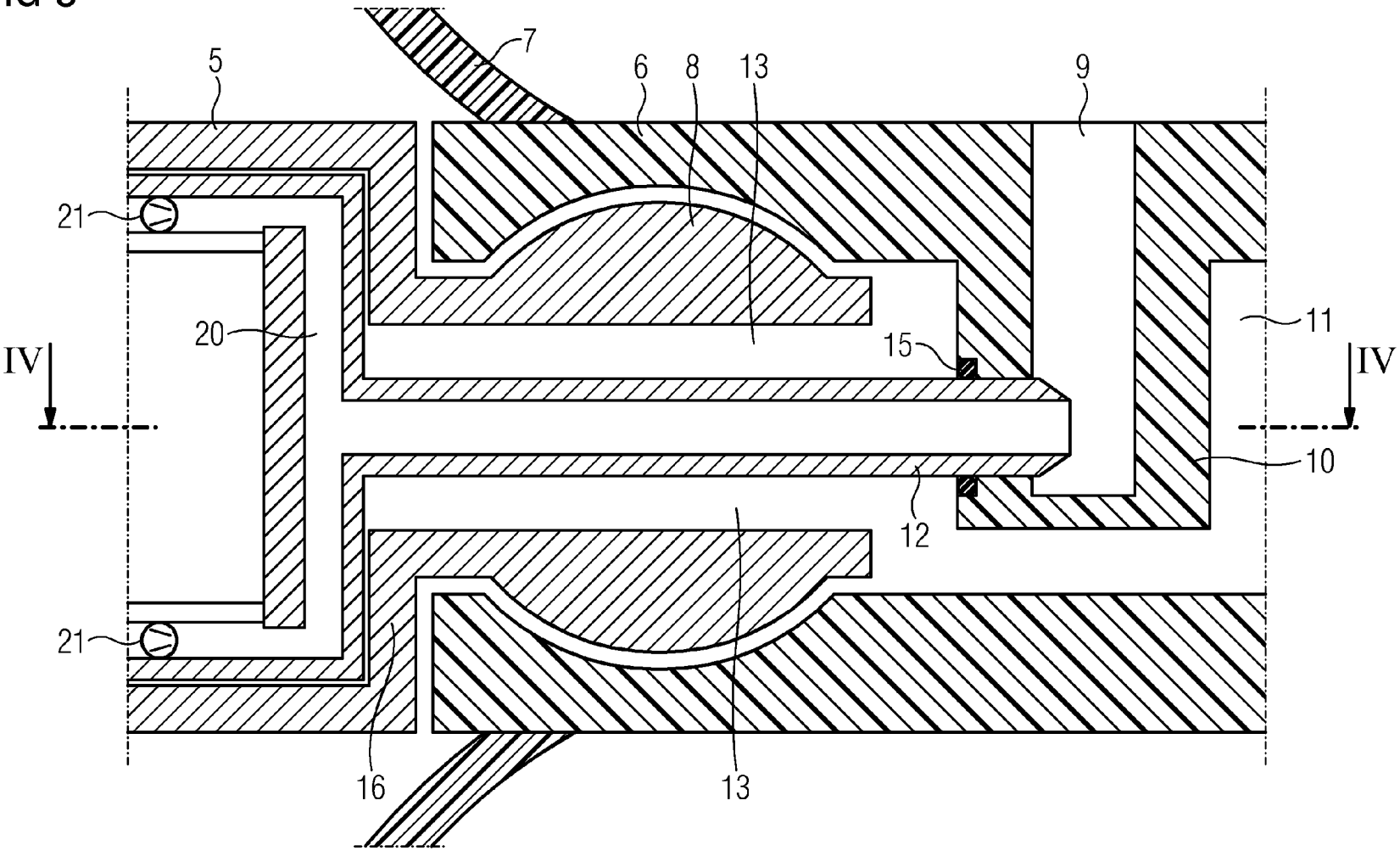
FIG. 3 is an enlarged detail of FIG. 2, illustrating the connection between the receiver module and the balloon module, the section taken along the line III-III in FIG. 4.

In order to assure a proper seal within the pneumatic system and to assure that the static pressure is retained inside the balloon for the required length of time (e.g., 16 hours for single-day use), there may be provided a special seal between the needle 12 and the appendix 10. As illustrated in FIG. 3, there is provided an O-ring 15 at the opening 14. In the alternative, it is also possible to coat the opening with a soft, elastomeric material, or to manufacture the appendix 10 of a pliable material that assures a proper seal against the needle 12 when the modules are connected. It is also possible to provide a relatively soft sealing washer or membrane at the opening 14. When the IEM is connected and the carrier 6 is snapped onto the snap-on dome 8, the needle 12 penetrates through the sealing washer or membrane and projects into the plenum formed by the bore inside the appendix 10. The sealing washer or membrane is formed of a suitable soft material, such as rubber or foam rubber, so that it seals around the needle and renders the connection between the pneumatic pumping system fluid-tight (i.e., gas tight and water tight).

It will be understood that the basic concept of the invention is not changed if the needle or microtube 12 forms a part of the balloon module and it is mounted centrally in the carrier 6. In that case, a connection and a seal is provided at the receiver side, for example centrally in a forward wall 16 of the receiver module. Again, the mount for the connection and the seal should be formed so as not to appreciably obstruct the sound conduction from the receiver 5 through the sound channel 13 and the axial bore 11.

To complete the functional description of the invention, it will be understood that the receiver module 5 contains the necessary electronics for generating a speaker signal for conversion to sound waves 8 at the forward end of the inflatable ear mold and for delivery to the tympanic membrane 3. It is thereby possible for the speaker to be provided inside the receiver, or to be located externally of the receiver 5. In one case, the receiver module 5 receives its information signal from an external assembly through a signal line 17, which may also double as a pull-out tether for the IEM. The external assembly may be a behind-the-ear (BTE) unit, a concha unit, an in-the-ear (ITE) unit, or even a completely-in-the-canal (CIC) hearing unit. In that case, the ear piece 4 as described herein may be integrally formed together with a CIC unit. If the sound transducer is provided in an external unit, such as a BTE unit, the signal travels from there to the receiver in the form of a sound tube. That is, the diagrammatic illustration of the signal line 17 may also be understood as a sound tube.

The signal line 17 may be joined by a pneumatic pressure line 18 for inflating and deflating the balloon 7. The pneumatic line 18 is illustrated as a separate tube but it may be fully integrated with, and formed integrally in a one-piece construction with the line 17. In one embodiment, an inflation pump and a valve may be provided in an external unit and the needle 12 is pneumatically connected with the pump/valve assembly through the line 18. In another embodiment, a pump/valve assembly 19 is disposed inside the receiver module 5. The pump may be an electrical pump or it may even be a manual pump. The user is enabled to inflate the IEM by suitable operation of a controller. Further, the user is also enabled to deflate the IEM so that the unit may be pulled from the auditory canal 2.

Figure 4:
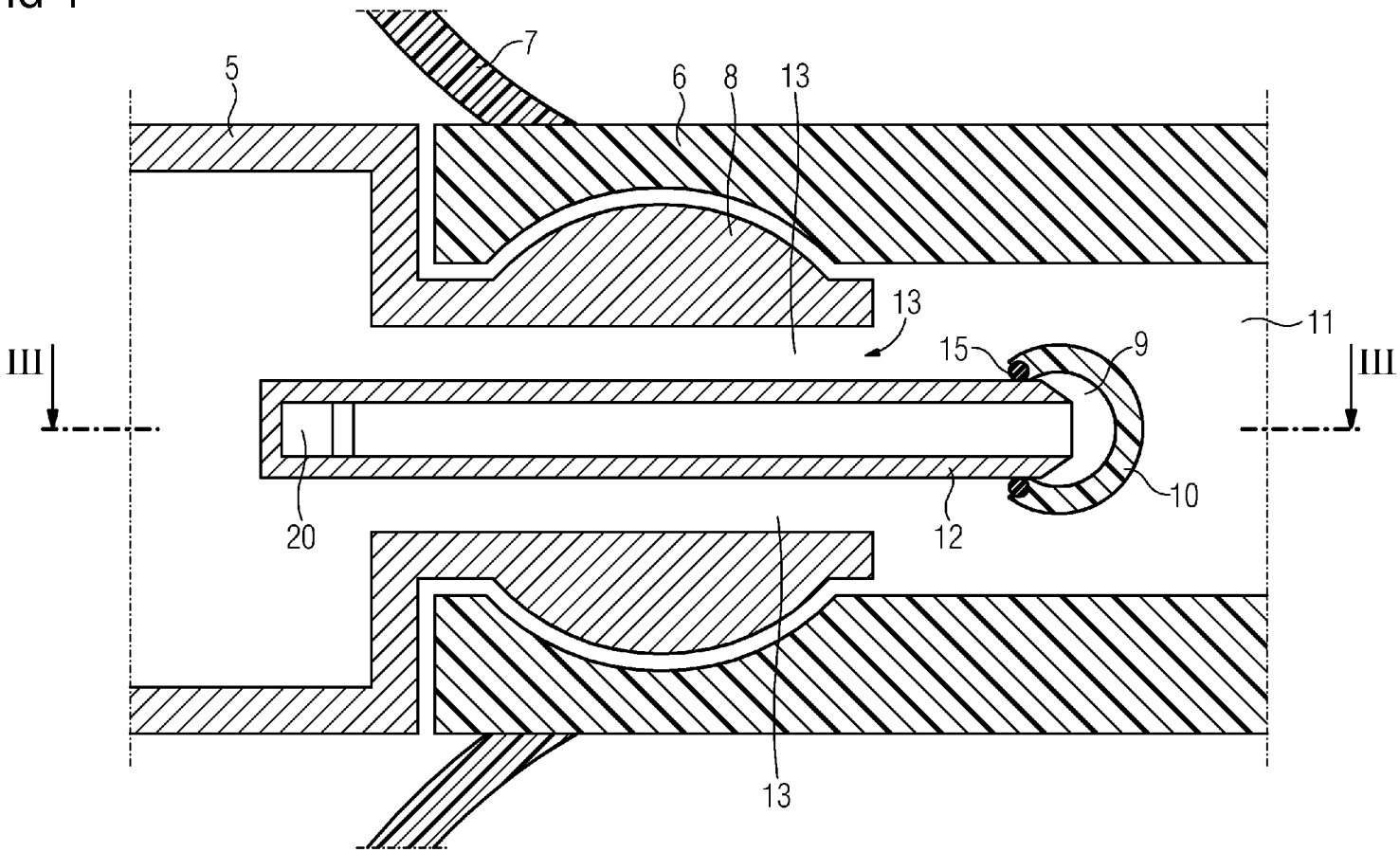
FIG. 4 is a view of the same detail, showing a longitudinal section taken along a plane IV-IV in FIG. 3 and rotated by 90 degrees relative to the section of FIG. 3.

FIGS. 3 and 4 show the same detail with sectional taken along planes that are perpendicular to one another. That is, FIG. 4 is a section that is taken along the line IV-IV in FIG. 3, centrally along the longitudinal axis of the assembly and vertically into the paper plane. The section of FIG. 3 cuts through the air flow duct 20, which leads from the pump/valve assembly 21 into the micro tube or needle 12, and also through the radial projection 10. As seen in FIG. 4, the air flow duct 20 obstructs the sound channel 13 leading from the receiver module 5 and through the connector bulb 8 only to a minor degree. Similarly, the radial projection 10, or the bridge 10, covers only a minor portion of the flow cross section inside the sound channel 11.

The invention claimed is:

1. An ear piece for a hearing device, the ear piece comprising:

an inflatable ear mold for insertion and placement in an ear canal, said inflatable ear mold having a carrier and an inflatable balloon sealingly mounted on said carrier;

a receiver module having a mount on a forward end thereof for connecting said receiver module to said carrier and said balloon;

said carrier having an axial bore formed along a central axis thereof, said bore forming a sound channel for conducting sound from said receiver module towards an ear drum inwardly bounding the ear canal;

a radial projection formed on a wall of said axial bore and jutting at least into a center of said axial bore and intersecting said central axis, said radial projection having an opening aligned with the central axis of said axial bore, said radial projection having a bore formed therein fluidically connecting an interior inflation space of said balloon with said opening;

a micro tube projecting centrally into said axial bore when said receiver and said carrier are connected, and projecting into and sealing against said opening in said radial projection, for enabling said balloon to be inflated, and optionally deflated, through said micro tube.

2. The ear piece according to claim 1, wherein said radial projection is an integral part of a bridge reaching across said axial bore and connecting to an inside wall of said carrier at diagonally opposed locations.

3. The ear piece according to claim 1, wherein said receiver module contains a sound source and wherein sound generated thereby is conducted through a forward wall of said receiver module, through said mount on said forward end thereof, and through said axial bore formed in said carrier.

4. The ear piece according to claim 1, wherein said receiver module contains a fluid source connected to said micro tube for selectively inflating said balloon.

5. The ear piece according to claim 4, wherein a fluidic connection is automatically formed and sealed between said fluid source and an interior of said inflatable balloon when said receiver module is connected to said carrier.

6. The ear piece according to claim 1, wherein said fluid source is a pump assembly comprising an air pump for inflating said balloon and a deflation valve for deflating said balloon.

7. The ear piece according to claim 1, wherein said receiver module is mounted to project the sound waves through said mount and is connected by way of a signal line to a device for delivering electronic signals for processing in said receiver module.

8. The ear piece according to claim 7, wherein said signal line includes an electrical cable carrying electrical control signals and an energy supply.

9. The ear piece according to claim 1, which comprises a tube pneumatically connecting said micro tube through said receiver module with an exterior pump for selectively inflating said balloon.

10. The ear piece according to claim 1, wherein said mount is a snap-on bulb and said carrier is formed with substantially congruent opening, wherein said carrier may be snapped onto said mount, and said micro tube is formed with a hollow needle tip penetrating into said radial projection as said carrier is snapped onto said mount, for contemporaneously forming a pneumatic connection to the interior of said balloon.

11. The ear piece according to claim 1 for use in combination with a hearing aid.

12. A hearing device, comprising:

an ear piece according to claim 1; and an external unit for transmitting to said ear piece sound signals or signals for generating sound waves to be perceived by the tympanic membrane.

13. The hearing device according to claim 12 formed as a hearing aid, wherein the external unit is a hearing unit selected from the group consisting of behind-the-ear (BTE), in-the-ear (ITE), concha, in-the-canal (ITC), and completely-in-the-canal (CIC) hearing unit.

14. The hearing device according to claim 12 formed as a CIC hearing aid having said external unit and said ear piece integrally connected to one another.

15. The hearing device according to claim 12, wherein the external unit is a sound player or a telephone.

* * * * *